US008297942B2

(12) United States Patent
Schmidt et al.

(10) Patent No.: US 8,297,942 B2
(45) Date of Patent: Oct. 30, 2012

(54) REGULATABLE COOLANT PUMP

(75) Inventors: Eugen Schmidt, Merbelsrod/Thueringen (DE); Franz Pawellek, Lautertal (DE); Eberhard Geissel, Kuenzell (DE); Dirk Hagen, Eisfeld (DE); Michael Rexhaeuser, Masserberg/Fehrenbach (DE)

(73) Assignee: Geraete- und Pumpenbau GmbH Dr. Eugen Schmidt, Merbelsrod / Thueringen (DE)

( * ) Notice: Subject to any disclaimer, the term of this patent is extended or adjusted under 35 U.S.C. 154(b) by 239 days.

(21) Appl. No.: 12/734,242

(22) PCT Filed: May 27, 2009

(86) PCT No.: PCT/DE2009/000751

§ 371 (c)(1),
(2), (4) Date: Apr. 20, 2010

(87) PCT Pub. No.: WO2009/143832

PCT Pub. Date: Dec. 3, 2009

(65) Prior Publication Data

US 2010/0284832 A1 Nov. 11, 2010

(30) Foreign Application Priority Data

May 30, 2008 (DE) ..... 10 2008 026 218

(51) Int. Cl.
*F04B 49/00* (2006.01)

(52) U.S. Cl. ..... 417/307; 415/158; 415/164

(58) Field of Classification Search ..... 417/307, 417/413.1; 415/158, 164
See application file for complete search history.

(56) References Cited

U.S. PATENT DOCUMENTS

| | | | |
|---|---|---|---|
| 3,784,318 | A | 1/1974 | Davis |
| 3,811,797 | A | 5/1974 | Lewis |
| 2008/0003120 | A1 | 1/2008 | Meza |
| 2008/0317609 | A1 | 12/2008 | Schmidt et al. |

FOREIGN PATENT DOCUMENTS

| | | |
|---|---|---|
| CH | 133 892 | 6/1929 |
| DE | 2 237 246 | 2/1973 |
| DE | 197 09 484 | 9/1998 |
| DE | 10 2005 004 315 | 8/2006 |
| DE | 10 2005 062 200 | 2/2007 |
| DE | 10 2006 034 960 | 1/2008 |
| DE | 10 2007 019 263 | 6/2008 |
| EP | 1 657 446 | 5/2006 |
| FR | 587 131 | 4/1925 |

OTHER PUBLICATIONS

International Search Report Apr. 20, 2010.

*Primary Examiner* — Charles Freay
*Assistant Examiner* — Patrick Hamo
(74) *Attorney, Agent, or Firm* — Collard & Roe, P.C.

(57) ABSTRACT

A controllable coolant pump for internal combustion engines is driven by a belt pulley. The controllable coolant pump has a hydraulically actuated gate valve connected to a ring piston. An axial piston pump is disposed in the pump housing and is driven and "operated" by means of a swashplate having a suction groove and disposed on the back side of the flywheel. The "pumped volume flow" of the pump is controlled in a defined manner by means of a solenoid valve such that precise displacement of the hydraulically actuated gate valve is ensured.

9 Claims, 8 Drawing Sheets

REGULATABLE COOLANT PUMP

CROSS REFERENCE TO RELATED APPLICATIONS

Figure 1:
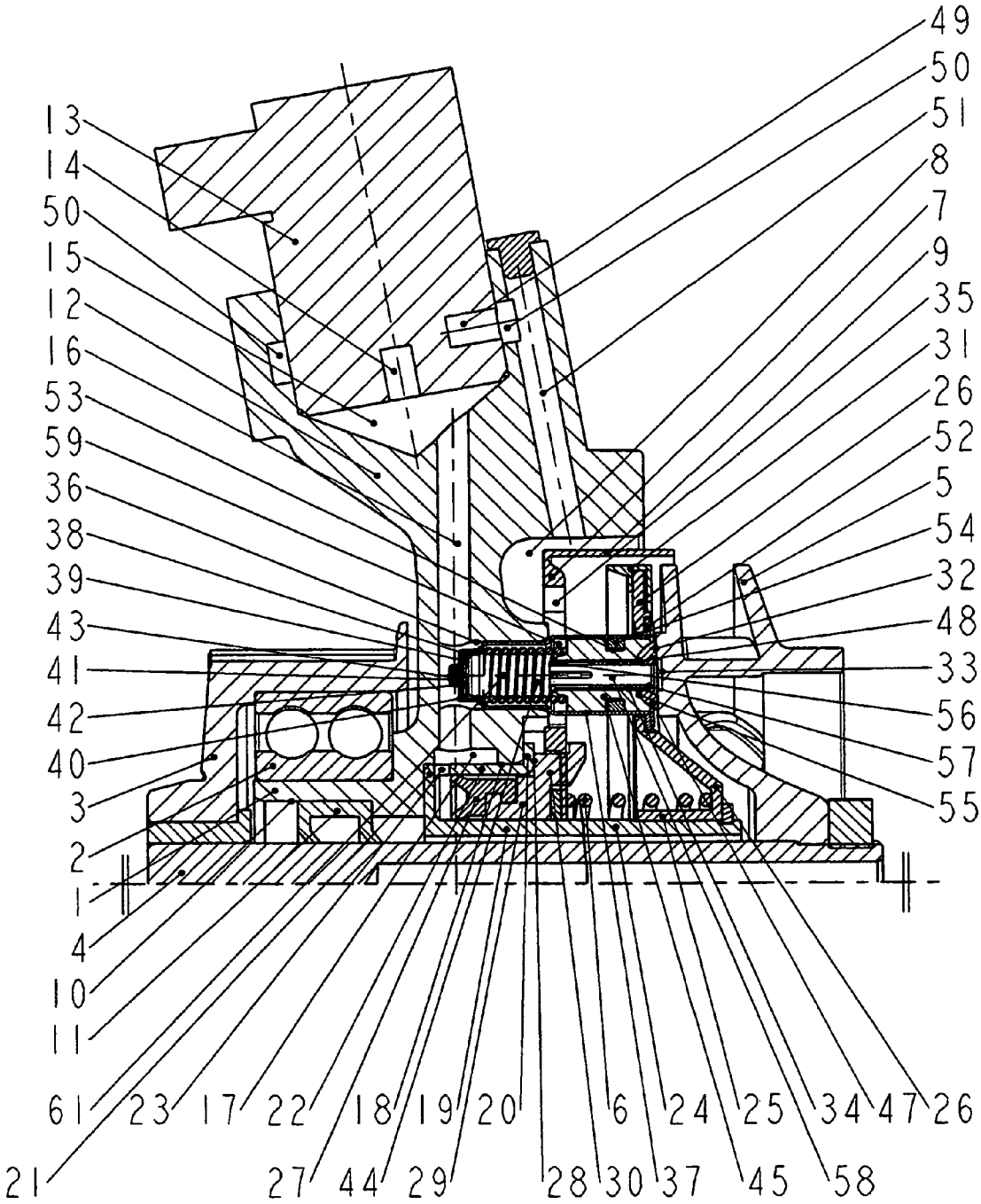

This application is the National Stage of PCT/DE2009/000751 filed on May 27, 2009, which claims priority under 35 U.S.C. §119 of German Application No. 10 2008 026 218.8 filed on May 30, 2008. The international application under PCT article 21(2) was not published in English.

The invention relates to a regulatable coolant pump for internal combustion engines that is driven by way of a pulley.

In the course of the constant optimization of internal combustion engines with regard to emissions and fuel consumption, it is important to bring the engine to operating temperature as quickly as possible after a cold start.

In this way, not only are friction losses minimized (the viscosity of the motor oil, and thus the friction at all oil-lubricated parts, drops with an increasing oil temperature), but at the same time, the emission values are reduced (since the catalytic converters only become effective after the so-called "start-up temperature," the time period until this temperature is reached significantly influences the exhaust gas emissions), and also, the fuel consumption is clearly reduced.

Series of experiments in engine development have shown that a very effective measure for warming the engine is "standing water" or "zero leakage" during the cold-start phase.

In this connection, coolant should not flow through the cylinder in any event, during the cold-start phase, in order to bring the exhaust gas temperature to the desired level as quickly as possible.

In this connection, leakage flows of less than 0.5 l/h ("zero leakage") are desired by vehicle manufacturers.

Studies concerning fuel consumption of internal combustion engines in motor vehicles have furthermore shown that about 3% to 5% fuel can be saved by means of consistent thermal management (in other words those measures that lead to optimal operation of an internal combustion engine, in terms of energy and thermomechanics).

In the state of the art, regulatable coolant pumps that are driven by the crankshaft of the internal combustion engine, by way of pulleys, are therefore also prescribed, in which the impeller is driven by the pump shaft, in switchable manner (for example by way of a friction pairing).

Using such coolant pumps, simple two-point regulation can be implemented, by means of which the cooling power of the coolant pumps can be varied.

In order to allow engine warm-up during a shorter time, at first, the drive of the coolant pump is uncoupled during cold start of the engine, by means of these designs.

Once the engine has reached its operating temperature, the friction clutch, in each instance (with the functionally related wear problems inherent to this clutch design) is activated, i.e. the drive of the coolant pump is turned on.

As a result, large amounts of the coolant, which is still cold, are immediately pumped into the engine, which has warmed up to operating temperature, so that the engine immediately cools off greatly again.

As a result, however, the desired advantages of rapid warm-up of the engine are already compensated again, in part.

Furthermore, because of the required mass acceleration when the pump is turned on again, particularly in the case of larger coolant pumps, very high torques must be overcome, and these necessarily result in great stress on the component.

Therefore two solutions that have proven themselves in the meantime were presented by the applicant, in DE 10 2005 004 315 B4 and in DE 10 2005 062 200 B3, which allow active control of the coolant feed amount, in order to guarantee optimal warm-up of the engine by means of "zero leakage," on the one hand, and, on the other hand, to influence the engine temperature after the engine has warmed up (i.e. in "continuous operation"), in such a manner that both the pollutant emission and the friction losses, and furthermore, at the same time, also the fuel consumption can be clearly reduced in the entire working range of the engine.

In these solutions, a valve slide configured in ring shape and mounted to be displaceable in the direction of the shaft axis of the pump shaft, in each instance, having an outer cylinder that variably covers the inflow region of the impeller, is disposed in the pump housing, which slide either acts on a magnetic armature rigidly connected with the valve slide, counter to the spring force of return springs, as proposed in the solution according to DE 10 2005 004 315 B4, electromagnetically, i.e. using a magnetic coil disposed in the pump housing, or, as proposed in DE 10 2005 062 200 B3, can be displaced in linear manner, by means of a pneumatically or hydraulically activated actuator (which acts hydraulically on piston rods rigidly disposed on the valve slide and guided in the pump housing).

This arrangement of a guided, linearly displaceable valve slide that variably covers the inflow region of the impeller is a very compact, simple, and robust solution, which guarantees great operational security and great reliability.

It is disadvantageous, however, that the production and the assembly of the designs presented in DE 10 2005 004 315 B4 and in DE 10 2005 062 200 B3 is still very cost-intensive, since most of the functional modules of the aforementioned solutions cannot be standardized, and since most of the functional modules must be produced separately for every pump size.

Furthermore, hydraulically activated actuators are also temperature-sensitive, since their dynamics are clearly impaired at fluid temperatures below 0° C.

In the installation of the electromagnetically activated coolant pumps, for example in the vicinity of the turbocharger, cooling of the magnetic coil (and thus a relatively large "construction space") is furthermore necessarily required, since otherwise, the magnetic coil would already be destroyed at temperatures starting at 120° C. A further disadvantage results from this relatively great "construction space" that is necessarily required, either for the magnetic coil disposed in the pump housing, as in DE 10 2005 004 315 B4, or the hydraulic or pneumatic actuators and their connection lines.

The "required" relatively large "construction space" of a regulatable coolant pump driven by way of a pulley is often diametrically opposed to the very severely limited "installation space" for the regulatable coolant pump that is available in the engine compartment.

The invention is therefore based on the task of developing a regulatable coolant pump (with valve slide) that is driven by way of a pulley, which pump eliminates the aforementioned disadvantages of the state of the art, and, in this connection, on the one hand guarantees optimal warm-up of the engine, by means of "zero leakage," and on the other hand is able to influence the engine temperature, in continuous operation, after the engine has warmed up, so precisely that not only the pollutant emission but also the friction losses and the fuel consumption can be clearly reduced, in the entire working range of the engine, and which allows reliable activation of the valve slide even under disadvantageous thermal general conditions, such as in the vicinity of the turbocharger, for example, but also in the case of very severely limited installation space for the coolant pump in the engine compartment, with very low drive power, and guarantees continued functioning of the coolant pump (fail-safe) even if the regulation fails, and is furthermore characterized by a design that is very simple in terms of production and assembly technology, cost-advantageous, "standardizable" for different pump sizes, optimally utilizes the construction space available in the engine compartment, while constantly guaranteeing a high level of operational security and reliability at a high volumetric degree of effectiveness, does not require air-free filling in the plant, and furthermore can be included in the engine management in simple and cost-advantageous manner.

According to the invention, this task is accomplished by means of a regulatable coolant pump for internal combustion engines that is driven by way of a pulley, according to the characteristics of the independent claim of the invention.

Advantageous embodiments, details, and characteristics of the invention are evident from the dependent claims as well as from the following description of two embodiments of the solution according to the invention, in connection with ten representations regarding these two embodiments of the solution according to the invention.

Figure 2:
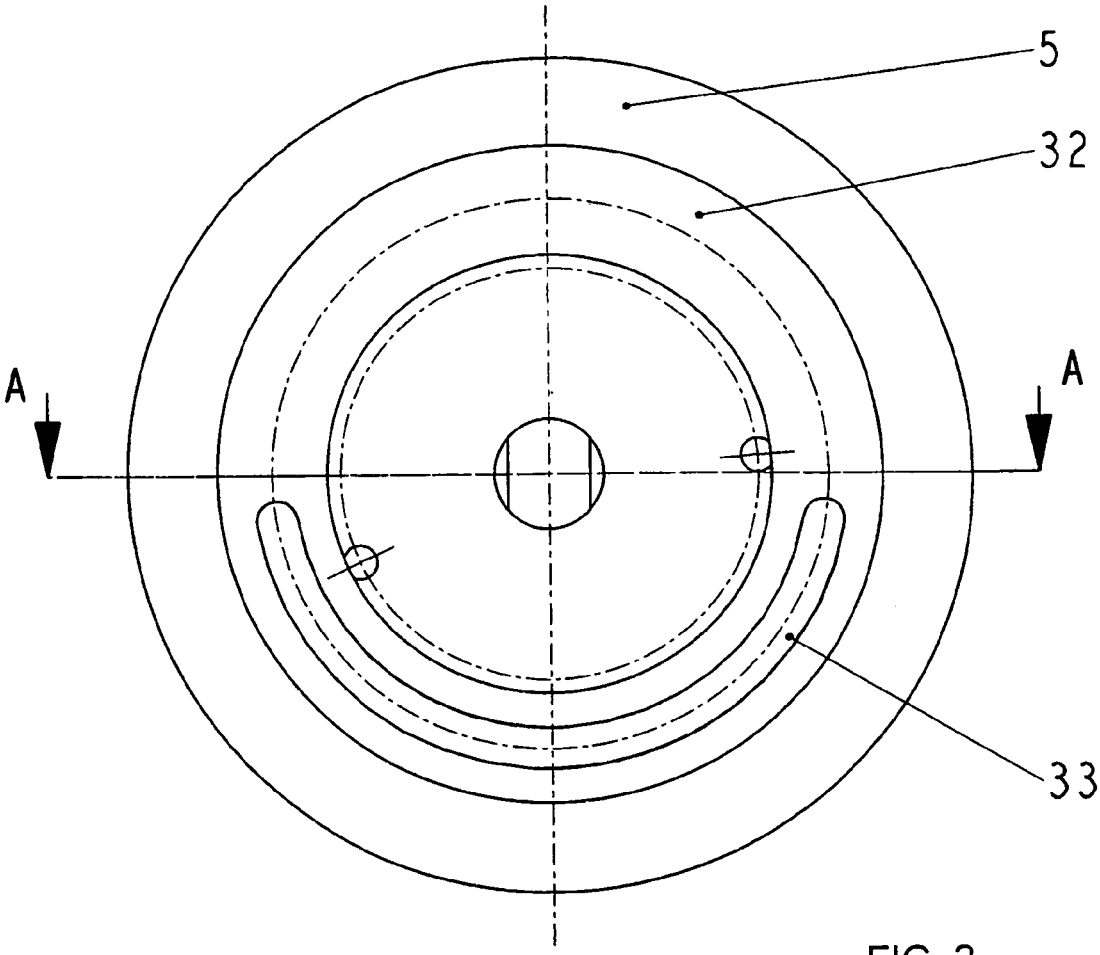
Figure 3:
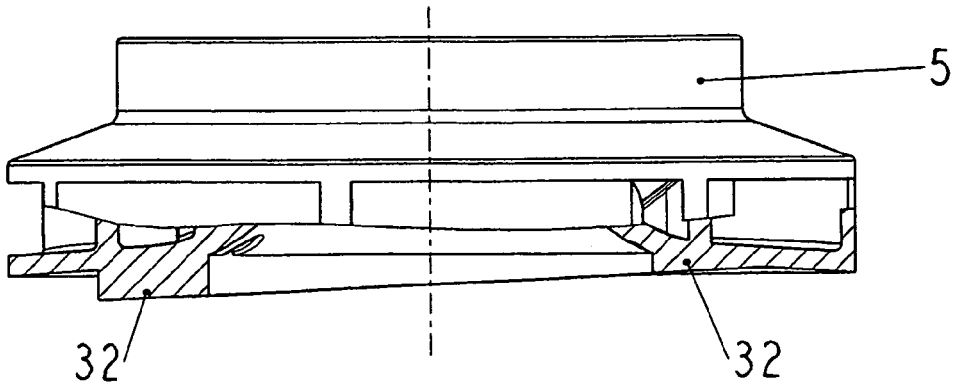
Figure 4:
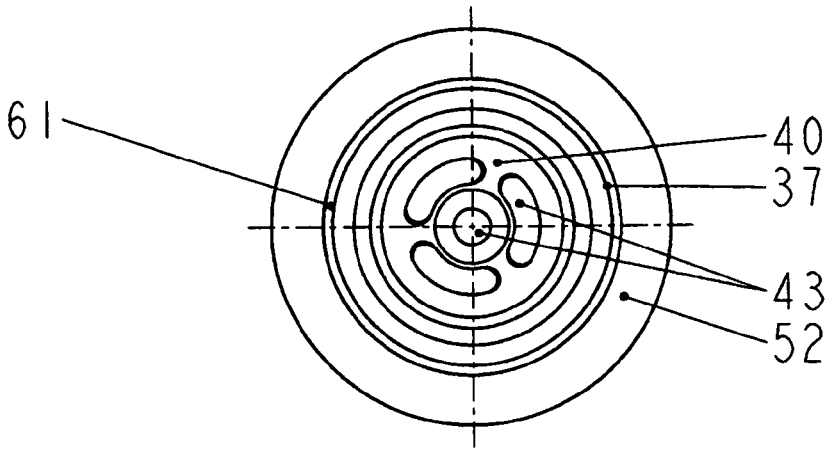
Figure 5:
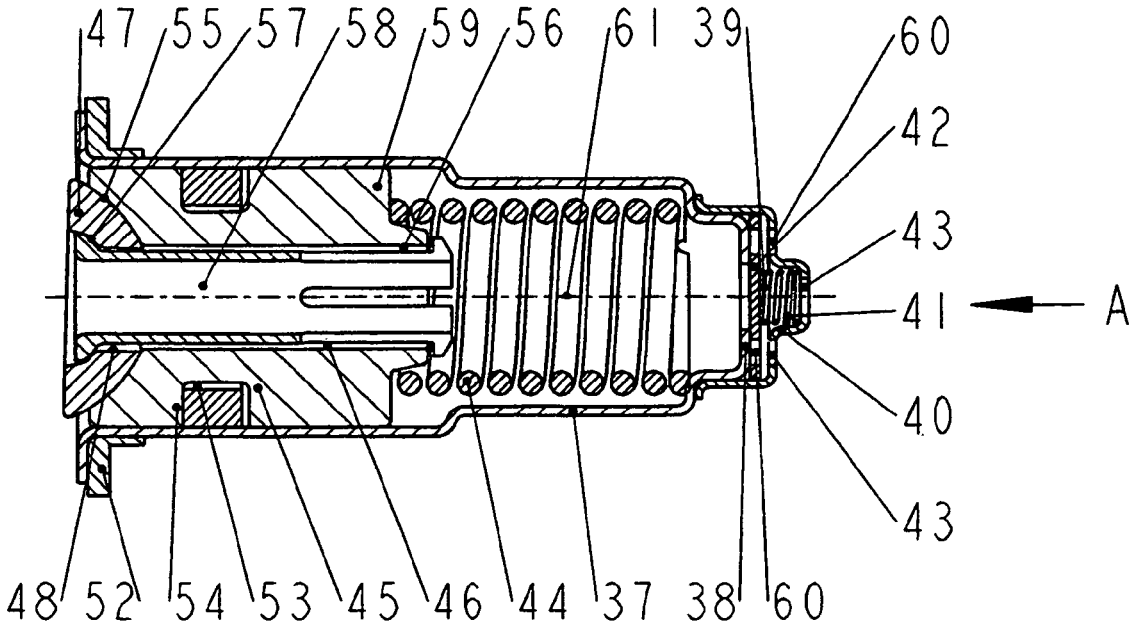
Figure 6:
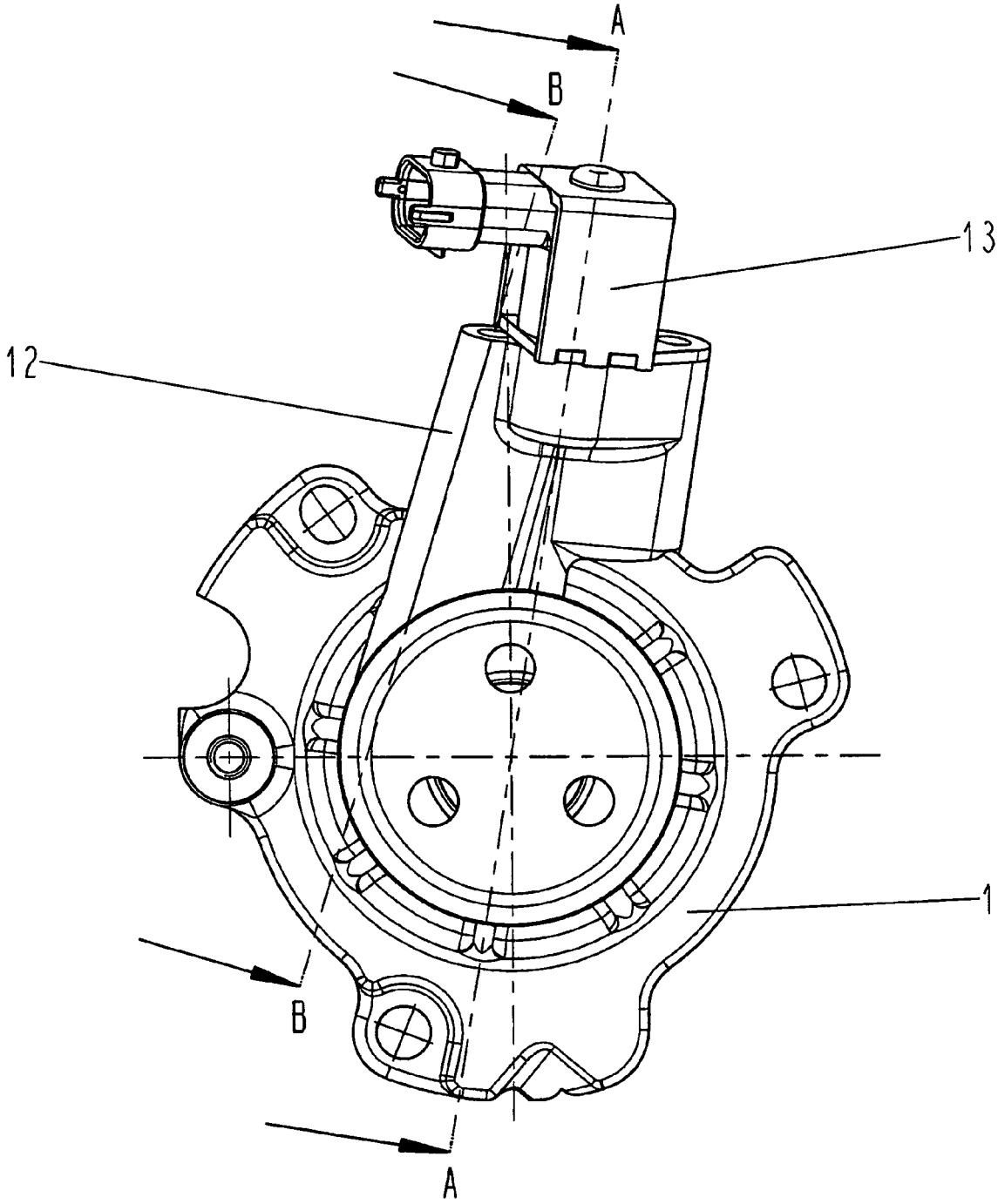
Figure 7:
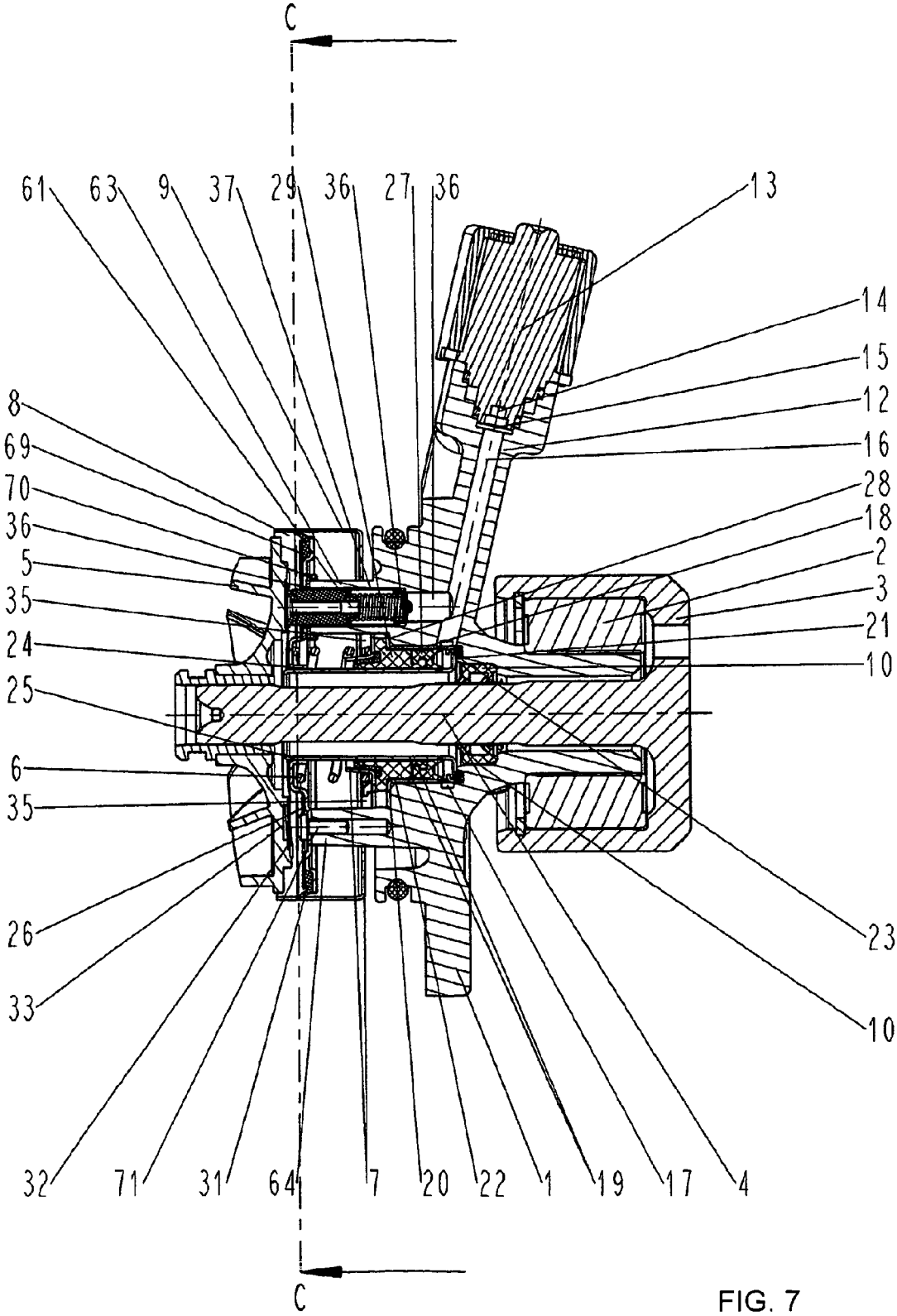
Figure 8:
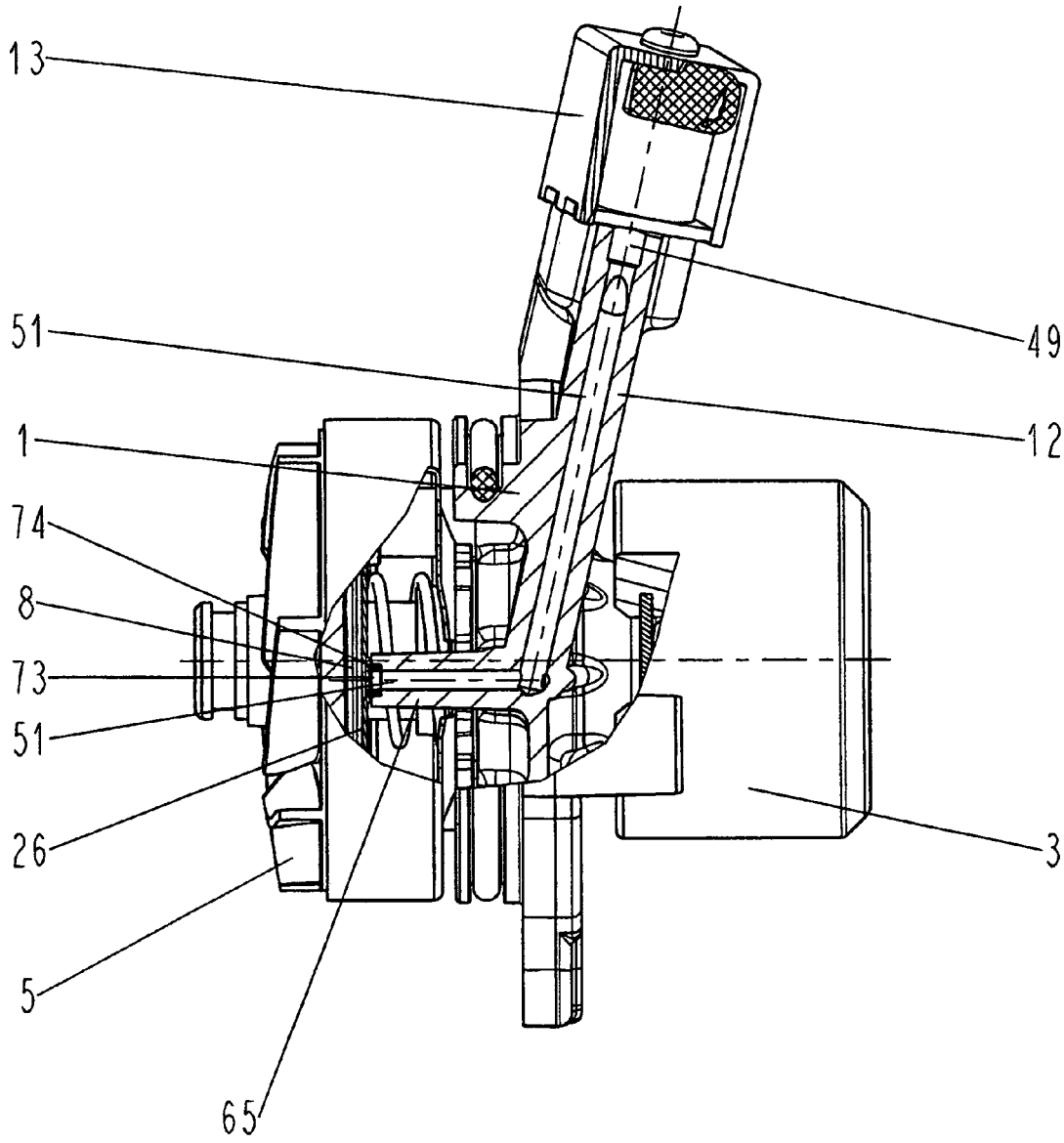
Figure 9:
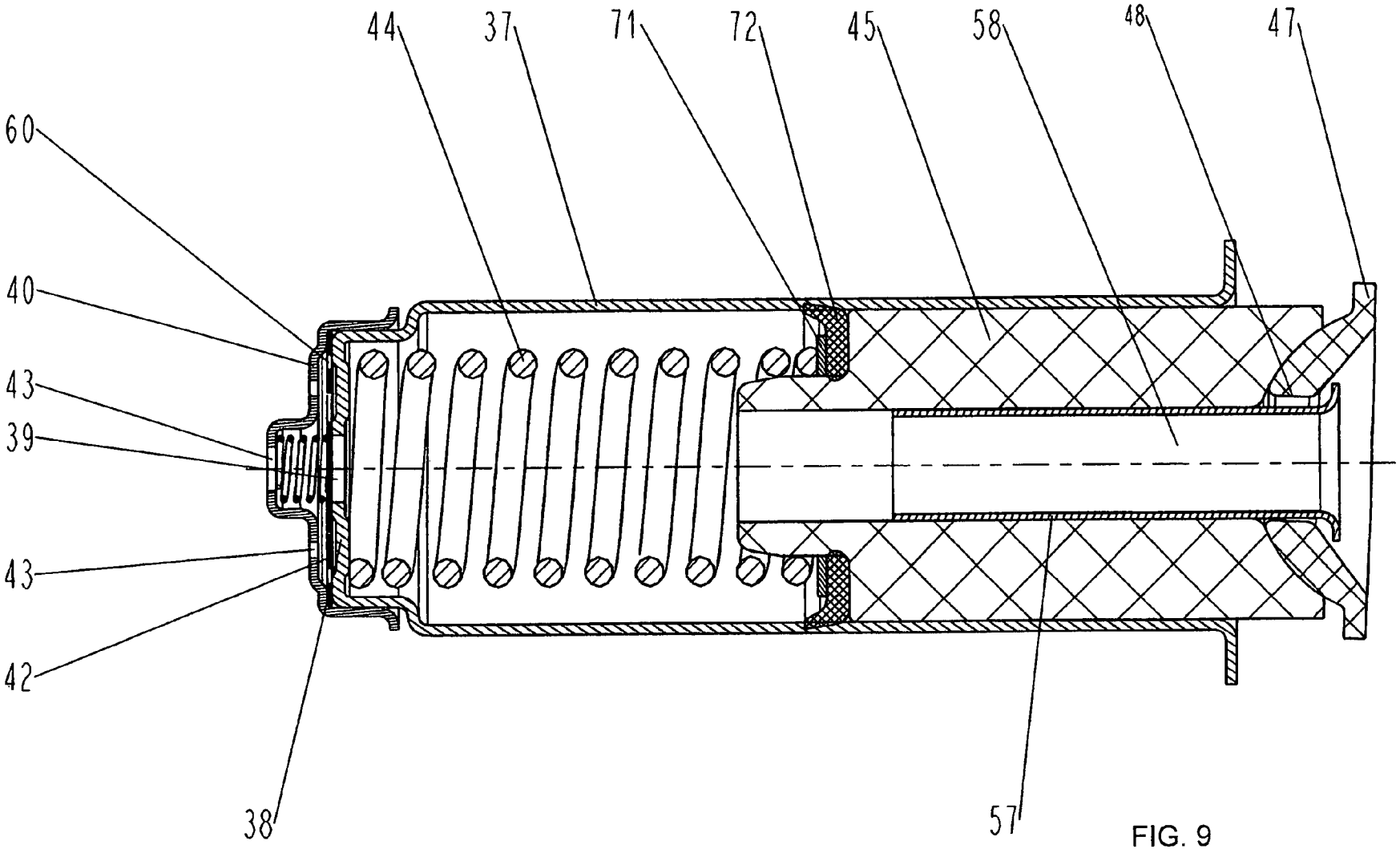
Figure 10:
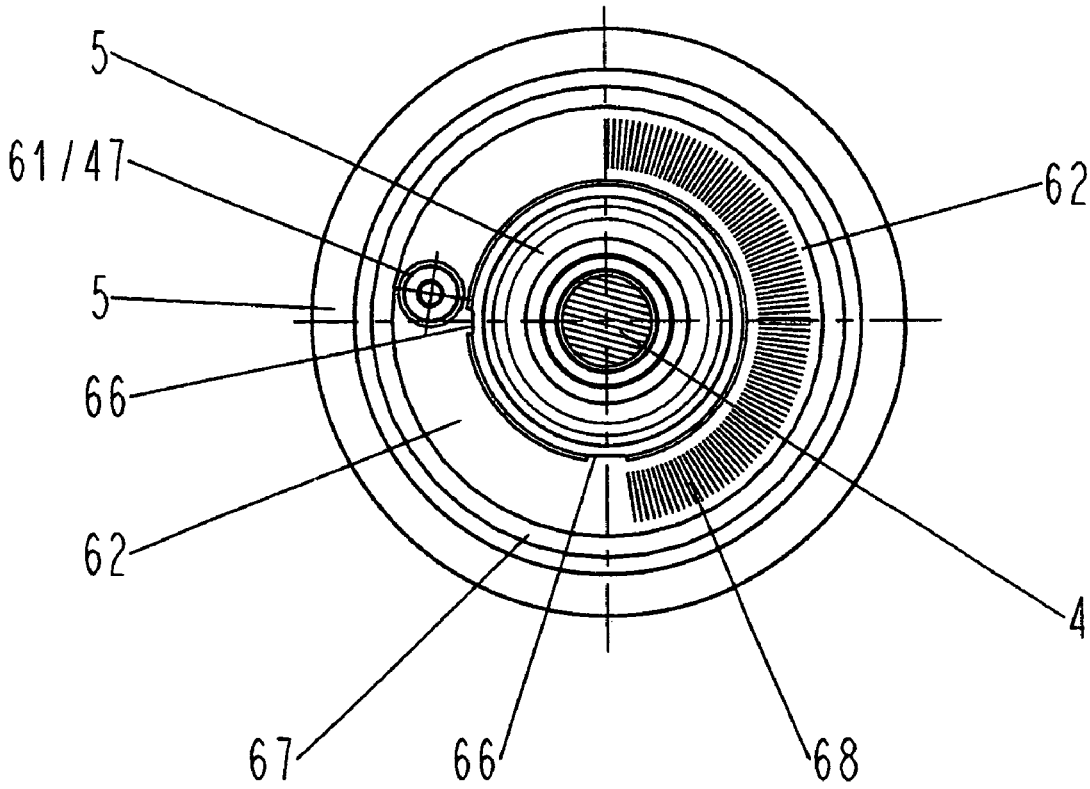

The drawing shows:

FIG. 1: the regulatable coolant pump according to the invention in a first embodiment, with a disk filter according to the invention, in section, in a side view;

FIG. 2: the impeller 5 of the regulatable coolant pump according to the invention, with a disk filter according to the invention, as an individual part, in a back view;

FIG. 3: the impeller 5 of the regulatable coolant pump according to the invention in partial section at A-A, according to FIG. 2;

FIG. 4: a top view of the separately represented module of the cylinder sleeve 37 with the axial piston pump 61 used in connection with the first embodiment;

FIG. 5: the cylinder sleeve 37 according to FIG. 4, with the components of the axial piston pump 61 (as a module) used in this embodiment integrated into the cylinder sleeve, in section, in a side view;

FIG. 6: the regulatable coolant pump according to the invention in a second embodiment, with a cyclone according to the invention, in a spatial representation;

FIG. 7: the regulatable coolant pump according to the invention in the second embodiment, with a cyclone according to the invention, in section at A-A according to FIG. 6, in a side view;

FIG. 8: the regulatable coolant pump according to the invention in the second embodiment, with a cyclone according to the invention, in section at B-B according to FIG. 6, in a side view;

FIG. 9: the cylinder sleeve 37 (according to FIG. 7), with the components of the axial piston pump 61 (as a module) used in the second embodiment integrated into the cylinder sleeve 37, in section, in a side view;

FIG. 10: the regulatable coolant pump according to the invention in the second embodiment, with cyclone, in section at C-C, according to FIG. 7.

In FIG. 1, the regulatable coolant pump according to the invention is shown in a first embodiment, with a disk filter, in section, in a side view, with the position of the valve slide in its backmost end position (i.e. in the working position "OPEN").

In this design, a pump shaft 4 driven by a pulley 3 is disposed on a pump housing 1, in a pump bearing 2, with an impeller 5 disposed on the free, flow-side end of this pump shaft 4, so as to rotate with it.

Furthermore, a pressure-activated valve slide that is spring-loaded by a return spring 6, and has a back wall 7 and an outer cylinder 9 that variably covers the outflow region of the impeller 5, is disposed in the pump interior 8.

A shaft sealing ring 11 is disposed in the pump housing 1, between the impeller 5 and the pump bearing 2, in a seal accommodation 10.

According to the invention, a working housing 12, in which a solenoid 13 having an inlet opening 14 is disposed, is disposed on the pump housing 1. Adjacent to this inlet opening 14, a pressure chamber 15 is disposed on the pump shaft side, in the working housing 12, which chamber empties into a pressure channel 16 that connects the pressure chamber 15 with a ring channel 17.

This ring channel 17, according to the invention, is worked into a sleeve accommodation, 18 disposed to lie opposite the sealing accommodation 10, on the impeller side, in the pump housing 1, with rotation symmetry relative to the axis of rotation of the shaft 4.

It is advantageous, in this connection, if the pump housing 1 and the working housing 12 are produced in one piece.

It is also essential to the invention that the outer cylinder 22 of a ring piston working sleeve 19, having a sealing crosspiece 20 and a bottom 21, is disposed within the sleeve accommodation 18, within the inner cylinder 24 of which sleeve the pump shaft 4 rotates freely.

In the outer cylinder 22 of the ring piston working sleeve 19, flow-through openings 23 to the ring channel 17 are disposed close to the bottom 21.

On the impeller-side end of the ring piston working sleeve 19, a position-securing sleeve 25, having a wall disk 26 disposed rigidly on the position-securing sleeve 25, is attached, with force fit, on the inner cylinder 24 of the ring piston working sleeve 19, which clearly projects beyond the outer cylinder 22 of the ring piston working sleeve 19.

It is also characteristic that a profile seal 27 is disposed spaced apart from the bottom 21 of the ring piston working sleeve 19 approximately by the diameter of the flow-through openings 23 and displaceable in the ring piston working sleeve 19. This is connected, on the impeller side, with a ring piston 29 provided with a crosspiece contact 28 with shape fit. The back wall 7 of the valve slide is disposed on the ring piston 29, in its impeller-side end region, with shape fit.

It is advantageous in this connection if the profile seal 27 is linked into a related entrainment groove disposed on the ring piston 29.

However, it is also advantageous if a seal is disposed between the sealing crosspiece 20 and the pump housing 1.

According to the invention, the return spring 6 is disposed between the wall disk 26 and the back wall 7 of the valve slide, which lies against the ring piston 29.

It is advantageous in this connection if an edge crosspiece 30 is disposed at the impeller-side end of the ring piston 29, which stabilizes the position of the back wall 7 of the valve slide during its working stroke.

It is furthermore characteristic that a bypass seal 31 is disposed at the outer edge of the wall disk 26, which prevents a pressure buildup between the wall disk 26 and the back wall 7 of the valve slide when the valve slide is "closed."

This arrangement of a cylinder-shaped, spring-loaded ring piston 29 guided in a ring piston working sleeve 19, according to the invention, now allows reliable, path-precise displacement of the outer cylinder 9 of the valve slide, by way of a defined application of pressure to the profile seal 27, and, at the same time, represents a construction-space-optimized, compact solution, which is furthermore simple in terms of production and assembly technology, as well as cost-advantageous and furthermore very robust, which always guarantees great operational security and reliability.

It is also essential to the invention that a slanted disk 32 is rigidly disposed on the impeller 5, on the pump housing side, into the "sinking region" of which disk a suction groove 33 is worked, whereby the transition region into the "rising region" as well as the entire "rising region" of the slanted disk 32 is configured to be planar.

The impeller 5 is shown in FIG. 2 as a detail, in a back view.

FIG. 3 shows the impeller 5 of the regulatable coolant pump according to the invention in partial section, according to FIG. 2 at A-A.

It is furthermore characteristic that in the wall disk 26, centered relative to the suction groove 33 disposed in the slanted disk 32, a push-through bore 34 and a push-through opening 35 that aligns with its bore axis are disposed in the back wall 7 of the valve slide, on the one hand, and an insertion bore 36 that opens into the pressure channel 16 is disposed in the pump housing 1, on the other hand.

It is essential to the invention that a cylinder sleeve 37 (with an axial piston pump 61 integrated into it) is disposed in the insertion bore 36 of the pump housing, with force fit.

In the present exemplary embodiment, a deep-drawn precision cylinder sleeve is pressed into the insertion bore 36 of the pump housing 1.

It is advantageous in this connection if a sealing ring 52 for sealing the cylinder sleeve 37 is disposed in the push-through bore 34 made in the wall disk 26, which prevents bypass leakages.

It is also characteristic that the wall of the push-through opening 35 disposed in the back wall 7 of the valve slide does not touch the mantle of the cylinder sleeve 37, so that the valve slide is freely displaceable along the cylinder sleeve 37.

FIG. 4 shows a top view of the axial piston pump 61 integrated into the cylinder sleeve 37, from the direction A, according to FIG. 5.

In the related FIG. 5, the cylinder sleeve 37 (according to FIG. 4) is shown with the components of the axial piston pump 61 integrated into it, in section, in a side view.

It is characteristic in this connection that an outflow opening 39 is disposed in the region of the cylinder sleeve bottom 38 of the cylinder sleeve 37.

It is essential in this connection that a valve basket 40 with a valve spring 41 and a valve disk 42 that is pressed against the cylinder sleeve bottom 38 by this valve spring 41, in the region of the outflow opening 39, is disposed in the region of the cylinder sleeve bottom 38, on the outside of the cylinder sleeve 37, and that multiple pass-through openings 43 are situated in the valve basket 40.

It is also essential to the invention that a working spring 44 is disposed in the cylinder sleeve 37, on which a working piston 45 having a flow-through bore 46 makes contact on the impeller side.

It is advantageous in this connection if a ring groove 53 is worked in on the outer cylinder of the working piston 45, in which groove a piston ring 54 is disposed, which serves for an optimal sealing effect with minimized friction losses.

According to the invention, a slide shoe 47 having a pass-through bore 48 worked into the related region of the suction groove 33, adjacent to the flow-through bore 46 of the working piston 45, is disposed between the spring-loaded working piston 45 and the slanted disk 32 of the impeller 5.

According to the invention, the contact region 55 between the slide shoe 47 and the working piston 45 is configured in the manner of a ball joint, so that the slide shoe 47 always lies against the related contact surface of the slanted disk in "even"—planar manner.

It is advantageous in this connection if the slide shoe 47 is attached to the working piston 45 by means of a clamping sleeve 57 provided with engagement hooks 56, whereby a sleeve pass-through bore 58 is disposed in the clamping sleeve.

In this way, not only the production costs but also the assembly costs are optimized.

If, now, the impeller 5 disposed on the pump shaft so as to rotate with it is driven by way of the pulley 3, in the case of the arrangement according to the invention shown in FIG. 1, then the working piston 45, which lies against the slanted disk 32 (tumble disk) with the slide shoe 47 is put into stroke movements in the piston space 59 of the cylinder sleeve 37.

In the present exemplary embodiment, the stroke per revolution lies at maximally one millimeter, since as the result of the arrangement according to the invention, very small feed amounts are sufficient for precise activation/displacement of the valve slide.

The arrangement according to the invention, in which the slide shoe 47, as shown in FIG. 1, lies against the slanted disk 32 on both sides of the suction groove 33, now brings about, when rotation of the impeller 5 takes place, that the slide shoe 47, which is pressed against the slanted disk, according to the invention, moves along the "sinking region" of the slanted disk 32 during a "suction stroke."

In this connection, inflow of the coolant defined according to the invention, by way of the suction groove 33 into the piston space 59 of the cylinder sleeve 37, takes place through the flow-through bore 46 disposed in the slide shoe 47 (or, respectively, the sleeve pass-through bore 58 of the clamping sleeve 57 disposed in the flow-through bore 46).

The suction groove 33 worked into the slanted disk 32 serves as a disk filter, according to the invention and in combination with the slide shoe 47, so that filtering of the coolant is brought about at the same time, during the inflow process.

As a result, the arrangement according to the invention is resistant to particles carried by the coolant (such as chips or grains of sand, for example).

In the present exemplary embodiment the suction groove 33 is worked into the slanted disk 32 with a depth of 0.1 mm.

When the slide shoe 47 pressed against the slanted disk 32 by means of the working spring 44, which is configured as a pressure spring, by way of the working piston 45, leaves the region provided with the suction groove 33, during its movement along the slanted disk 32, the inflow process is ended.

During its subsequent movement along the "rising region" of the slanted disk 32, the slide shoe 47 then presses the working piston 45 into the piston space 59 of the cylinder sleeve 37.

In this connection, the coolant that was previously drawn into the piston space 59, in filtered manner, is pressed by way of the outflow opening 39 disposed in the cylinder sleeve bottom 38 of the cylinder sleeve 37.

In this connection, the valve disk 42 loaded by means of the valve spring 41 is raised, and, at the same time, the coolant that is drawn in is pressed into the pressure channel 16 by way of the bores 60 disposed at the edge of the valve disk 42, through the pass-through openings 43 disposed in the valve basket 40.

Adjacent to the outlet opening 49 disposed in the solenoid 13, an outflow groove 50 is disposed in the working housing 12, according to the invention.

It is essential to the invention that this outflow groove 50 is connected with the pump interior 8 by way of a backflow bore 51 that leads from the working housing 12 into the pump housing 1.

The solenoid 13 is open when no current is applied to it.

The working piston 45 of the piston pump conveys the cooling fluid back into the pump interior when the solenoid 13 is "open," without pressure, by way of the outlet opening 49 of the solenoid 13.

If necessary, the pressure (in the pressure channel 16, in the ring channel 17, and in the space of the ring piston working sleeve 19 connected with the ring channel 17) is increased, in step-free manner, by means of the solenoid 13.

In this connection, the cooling fluid conveyed by the piston pump gets into the ring channel 17, and from there it is pressed into the ring piston working sleeve 19 by way of the flow-through openings 23.

There, the cooling fluid pressed in in this manner brings about a defined (adjustable by way of the solenoid 13) application of pressure to the profile seal 27 and thus an application of pressure to the spring-loaded ring piston 29, which can therefore be moved in translationally precise manner.

Because of the arrangement according to the invention, defined displacement of the outer cylinder 9 of the valve slide is thereby brought about, and precise regulation of the conveyed coolant volume flow is implemented.

After the warm-up phase of the engine (with the valve slide closed), the pressure in the pressure channel can be precisely regulated by means of the solenoid, in this manner, and thus defined displacement of the valve slide along the outer edge of the impeller can be implemented, thereby in turn making it possible to precisely influence the engine temperature in continuous operation, so that not only the pollutant emission but also the friction losses and fuel consumption can be clearly reduced in the entire working range of the engine.

Even in the case of disadvantageous thermal general conditions, such as in the vicinity of the turbocharger, for example, and very severely limited installation space for the coolant pump in the engine compartment, the solution according to the invention guarantees optimal cooling with minimized construction volume, as a result of the provision of a solenoid that is integrated into the coolant pump housing and, at the same time, cooled by coolant in the coolant pump housing.

Furthermore, the solution according to the invention allows reliable activation of the valve slide with a very low drive power.

Even in the event of failure of the regulation, continued functioning of the coolant pump (fail-safe) is guaranteed by the solution according to the invention, since the solenoid is open in the current-free state, so that the pressure in the pressure channel 16 and in the ring channel 17 drops, and the return spring 6 moves the valve slide into the (backmost) working position "OPEN" in this case.

In the event of spring-loaded "return movement" of the ring piston 29 into the "fail-safe position," the coolant pumped by the working piston is passed from the pressure channel 16 to the return bore 51, by way of the open solenoid 13, and from there back into the pump interior 8 of the coolant pump according to the invention.

In FIGS. 6 to 10, another embodiment of the regulatable coolant pump according to the invention is now shown.

FIG. 6 shows this second embodiment, equipped with a special cyclone according to the invention, in a spatial representation.

In this connection, again, a working housing 12 with a solenoid 13 is disposed on the pump housing 1.

FIG. 7 shows the regulatable coolant pump according to the invention in a side view, in a section at A-A, according to FIG. 6.

This second embodiment of the regulatable coolant pump according to the invention is also, once again, equipped with a pump housing 1, a pump shaft 4 mounted in/on the pump housing 1, in a pump bearing 2, and driven by a pulley 3, an impeller 5 disposed on a free, flow-side end of this pump shaft 4, so as to rotate with it, a pressure-activated valve slide spring-loaded by a return spring 6, provided with a back wall 7 and an outer cylinder 9 that variably covers the outflow region of the impeller 5, and disposed in the pump interior 8, as well as a shaft sealing ring 11 disposed in the pump housing 1 between the impeller 5 and the pump bearing 2, in a seal accommodation 10.

According to the invention, this construction is characterized in that a solenoid 13 having an inlet opening 14 is disposed in the working housing 12 disposed on the pump housing 1, whereby a pressure chamber 15 is also disposed adjacent to this inlet opening 14, on the pump shaft side, in the working housing 12, into which chamber the pressure channel 16 opens, which connects the pressure chamber 15 with a ring channel 17, which is worked into a sleeve accommodation 18 that lies opposite the sealing accommodation 10, in the pump housing 1, on the impeller side, with rotation symmetry relative to the axis of rotation of the pump shaft 4. According to the invention, again, a ring piston working sleeve 19 having a sealing crosspiece 20 and a bottom 21 is disposed in the sleeve accommodation 18, in which sleeve the pump shaft 4 rotates freely, and in the outer cylinder 22 of which sleeve, close to the bottom 21, flow-through openings 23 to the ring channel 17 are disposed, whereby at the impeller-side end of the inner cylinder 24 of the ring piston working sleeve 19, which clearly projects beyond the outer cylinder 22, a position-securing sleeve 25 having a wall disk 26 rigidly disposed on it is disposed, with force fit, and a profile seal 27 is disposed to be displaceable in the ring piston working sleeve 19, at a distance from the bottom 21 of the ring piston working sleeve 19 of approximately the diameter of the flow-through openings 23, which seal is connected, on the impeller side, with a ring piston 29 provided with a contact crosspiece 28, on the impeller-side face wall of which the back wall 7 of the valve slide is disposed, with shape fit or force fit, whereby the return spring 6 is disposed between the wall disk 26 and the ring piston 29, or the wall disk 26 and the back wall 7 of the valve slide that lies against/is disposed on the ring piston 29.

This arrangement of a cylinder-shaped, spring-loaded ring piston 29 guided in a ring piston working sleeve 19, together with all the effects according to the invention that have already been described in connection with the preceding embodiments (shown in FIGS. 1 to 5), now allows reliable, path-precise displacement of the outer cylinder 9 of the valve slide, by way of a defined application of pressure to the profile seal 27, and, at the same time, represents a construction-space-optimized, compact solution, which is simple in terms of production and assembly technology, as well as cost-advantageous and furthermore very robust, and always guarantees great operational security and reliability.

It is also characteristic in this connection that in this embodiment, a bypass seal 31 is disposed on the outer edge of the wall disk 26, in such a manner that the seal prevents pressure buildup between the wall disk 26 and the back wall of the valve slide in any position of the valve slide, and thereby allows displacement of the valve slide in even more precise (sensitive) manner, as compared with the solution shown in FIGS. 1 to 5.

It is essential to the invention that a slanted disk 32 is rigidly disposed on the impeller 5, on the pump housing side, in this design, as well, in the "sinking region" of which disk a suction groove 33 is introduced, whereby the transition region into the "rising region" as well as the entire "rising region" of the slanted disk are configured to be evenly planar.

It is also characteristic in this connection that multiple domes that project beyond the pump housing 1 in the direction of the impeller 5, a pump dome 63, one or more wall disk attachment domes 64, as well as a backflow dome 65, are disposed on the pump housing 1, and that related push-through openings 35 are disposed in the back wall 7, in the region of these domes, which guarantee "free" mobility of the valve slide.

It is furthermore characteristic that the wall disk 26 is firmly disposed on the wall disk attachment domes 64 of the pump housing 1, using attachment elements 71, and that in the wall disk 26, which is firmly connected with the pump housing 1 by way of the wall disk attachment domes 64, on the one hand, a push-through bore 34 is provided, centered relative to the suction groove 33 disposed in the slanted disk 32, and an insertion bore 36 that opens into the pressure channel 16 is disposed in the pump dome 63 of the pump housing 1, aligned with the bore axis of the push-through bore, and that on the other hand, a wall disk pass-through bore 73 is provided, which is disposed centered relative to the bore axis of a backflow bore 51 disposed in the backflow dome 65.

It is advantageous if a pump dome seal 70 is disposed between the insertion bore 36 in the pump dome 63 and the push-through bore 34 disposed in the wall disk 26, on the pump dome 63 as shown in FIG. 7, which seal prevents leakages between the components that are adjacent there.

It is furthermore advantageous if a backflow seal 74 is also disposed on the backflow dome 65 as shown in FIG. 8, in the exit region of the backflow bore 51, between the backflow bore 51 and the wall disk pass-through bore 73 disposed in the wall disk 26, which prevents leakages between the components that are adjacent there.

According to the invention, a cylinder sleeve 37 having an axial piston pump 61 integrated into this cylinder sleeve 37 is disposed in the insertion bore 36 in the pump dome 63 of the pump housing 1, with shape fit and force fit.

In FIG. 9, this cylinder sleeve 37 according to FIG. 7 is shown with the components of the axial piston pump 61 used in this embodiment integrated into the cylinder sleeve 37, in section, in a side view.

It is according to the invention, in this connection, that an outflow opening 39 is disposed in the region of the cylinder sleeve bottom 38 of the cylinder sleeve 37, and that a valve basket 40 having a valve spring 41 and a valve disk 42 pressed against the cylinder sleeve bottom 38, in the region of the outflow opening 39, by this valve spring 41 is disposed in the region of the cylinder sleeve bottom 38, on the outside of the cylinder sleeve 37, whereby one/more pass-through opening(s) 43 is/are situated in the valve basket 40, and a working spring 44 is disposed in the cylinder sleeve 37, as a further module of the axial piston pump 61, on which spring the related working piston 45 provided with a flow-through bore 46 rests on the impeller side.

It is essential to the invention that a slide shoe 47 having a pass-through bore 48 introduced in the related region of the suction groove 33, adjacent to the flow-through bore 46 of the working piston 45, is disposed between the spring-loaded working piston 45 of the axial piston pump 61 and the slanted disk 32 of the impeller 5 (FIG. 7).

If the impeller 5 disposed on the pump shaft 4 so as to rotate with it is now driven by way of the pulley 3, in the case of the arrangement according to the invention shown in FIG. 7, then the working piston 45 of the axial piston pump 61, which lies against the slanted disk 32 (tumble disk) with the slide shoe 47 is put into stroke movements in the piston space 59 of the cylinder sleeve 37.

In the present exemplary embodiment, the stroke per revolution lies at maximally two millimeters, since even slight feed amounts are already sufficient for precise activation/displacement of the valve slide, as a result of the arrangement according to the invention.

FIG. 10 now shows the regulatable coolant pump according to the invention, according to FIG. 7, with the cyclone according to the invention, in section at C-C.

According to the invention, in this embodiment a suction groove 33 having a depth of about 0.6 mm, worked into the slanted disk 32, is covered by means of a cyclone 62 that covers the suction groove 33 and is disposed between the slanted disk 32 and the slide shoe 47.

This cyclone 62, which covers the slanted disk 32 on the impeller 5 on the pump housing side, is connected, according to the invention, with shape fit by means of engagement projections 66, and with force fit by means of a clamping ring 67, with the slanted disk 62 on the impeller 5.

It is characteristic that the cyclone 62 is formed by a thin-walled circular ring disk disposed in the region of the suction groove 33, in which disk, as shown in FIG. 10, a plurality of laser bores 68 are disposed in the region of the suction groove 33.

In the present exemplary embodiment, approximately 4000 laser bores are disposed in the cyclone 62 in the region of the suction groove 33.

Because of the force-fit and shape-fit placement of the cyclone 62 on the slanted disk 32 of the impeller 5, secure location positioning of the region provided with laser bores in the region of the suction groove 33 of the slanted disk 32 is guaranteed even in the event of a greatly contaminated cyclone 62, during the working stroke of the axial piston pump 61.

In the present exemplary embodiment, the thickness of the circular ring disk of the cyclone 62 according to the invention amounts to 0.3 mm, and the laser bores 68 that are used in this exemplary embodiment have a conical cross-section. The smallest diameter of these conical laser bores 68 amounts to 0.1 mm, and according to the invention, it is disposed on the side of the cyclone 62 that faces the slide shoe 47.

The related greatest diameter of these conical laser bores 68, which faces the suction groove 33, amounts to 0.15 mm in the present exemplary embodiment.

The arrangement according to the invention, shown in FIGS. 7 to 10, with the cyclone 62 according to the invention, disposed on the slanted disk 32, and the slide shoe 47 of the axial piston pump 61 that lies against the cyclone 62, now brings the result, when the impeller 5 rotates, that the slide shoe 47, which is pressed against the cyclone 62 during the "suction stroke," according to the invention, along the "sinking region" of the slanted disk 32, moves with the suction groove 33 disposed in the "sinking region" of the slanted disk 32.

The cyclone 62, which is disposed between the slanted disk 32 and the slide shoe 47 of the axial piston pump 61 in this design, is provided with laser bores 68 in the region of the suction groove 33.

During the "suction stroke," defined inflow of the coolant by way of the suction groove 33 into the piston space 59 of the cylinder sleeve 37 now takes place from the suction groove 33, through the laser bores 68, into the flow-through bore 46 disposed in the slide shoe 47 (i.e. through the sleeve pass-through bore 58 of the clamping sleeve 57 disposed in the flow-through bore 46).

The cyclone 62 according to the invention, disposed between the slanted disk 32 and the slide shoe 47 of the axial piston pump 61, now allows a suction groove 33 that is worked significantly deeper into the slanted disk 32, as compared with the design presented in the first exemplary embodiment having a disk filter, with all the flow technology advantages that result from this.

In this connection, the cyclone 62 according to the invention first brings about filtering of the coolant that flows into the suction groove 33, on the one hand as a "gravity separator," since the force of gravity that acts on undesirable foreign bodies (such as chips, grains of sand, or the like, for example) that are entrained by the cooling medium as the result of the circumferential velocity of the impeller 5 (with which the cyclone 62 rotates) is significantly greater in the region of the laser bores 68, as compared with the "suction force" that acts on the foreign bodies as the result of the inflow velocity into the laser bores 68.

At the same time, the cyclone 62 acts as a "baffle separator," since all the foreign bodies that do not hit the laser bores 68 precisely bounce off the "base material of the cyclone" 62 disposed between the laser bores 68, and then are additionally rejected by the centrifugal force effect.

As a result of the conical configuration of the laser bores 68 according to the invention, these act as a confusor and bring about a minimization of the pressure loss in the suction intake phase, among other things.

Furthermore, the slide shoe 47 of the axial piston pump 61, which "passes over" the region of the cyclone 62 that is provided with laser bores 68 during every revolution, has a "stripping effect" and thus leads to an additional self-cleaning effect.

This self-cleaning effect is furthermore supported in that flow takes place through each laser bore 68 twice (once into the suction groove 33 and then out of the suction groove 33 again, by way of the slide shoe 47) during each revolution of the impeller 5, and is additionally flushed clean when this happens.

Even in the event of longer periods of non-use of the vehicle, during which the laser bores 68 can become "clogged" with gels or particles as the result of crystallization effects, the arrangement according to the invention brings about a cleaning effect that comes very close to ultrasound cleaning (at an engine speed of 3000 rpm, for example, at which the laser bore region of the cyclone 62 is passed over fifty times a second, with all the aforementioned effects and a very high suction pressure, as the result of the closed laser bores), and as a result, the cyclone 62 according to the invention cleans itself even under extreme conditions, and even crystals that have already formed go back into solution.

This arrangement according to the invention allows a clearly higher "inflow volume stream" as compared with the embodiment presented in the first exemplary embodiment, while it is resistant to the particles entrained by the coolant and furthermore guarantees a very long useful lifetime at greatest reliability.

The principle of action of the embodiment presented in FIGS. 6 to 10 is analogous to the embodiment already explained in connection with FIGS. 1 to 5.

When the slide shoe 47, which is pressed against the slanted disk 32 (by way of the working piston 45) by means of the working spring 44 configured as a pressure spring, leaves the region that covers the suction groove 33 by means of laser bores 68, during its movement along the cyclone 62 disposed on the slanted disk 32, then the inflow process is ended.

During its subsequent movement along the "rising region" of the slanted disk 32, the slide shoe 47 then presses the work piston 45 into the piston space 59 of the cylinder sleeve 37.

In this connection, the coolant that was previously drawn into the piston space 59, in filtered manner, is pressed by way of the outflow opening 39 disposed in the cylinder sleeve bottom 38 of the cylinder sleeve 37.

In this connection, the valve disk 42 loaded by the valve spring 41 is raised and, at the same time, the coolant that has been drawn in is pressed into the pressure channel 16 (FIG. 7), by way of the bores 60 disposed at the edge of the valve disk 42, through the pass-through openings 43 disposed in the valve basket 40.

In FIG. 8, the regulatable coolant pump according to the invention, from FIG. 6, is now shown in a side view, in the section B-B.

This sectional representation according to FIG. 8 shows that an outlet opening 49 is disposed on the solenoid 13, with backflow bores 51 disposed adjacent to it, in the working housing 12, which lead from the working housing 12 into the pump housing 1, and connect the outlet opening 49 with the pump interior 8. The solenoid 13 is open when no current is applied to it.

The working piston 45 of the piston pump conveys the flue back into the pump interior 8 when the solenoid 13 is "open," without pressure, by way of the outlet opening 49 of the solenoid 13.

If necessary, the pressure (in the pressure channel 16, in the ring channel 17, and in the space of the ring piston working sleeve 19 that is connected with the ring channel 17) is increased, in step-free manner, by means of the solenoid 13.

In this connection, the cooling fluid conveyed by the axial piston pump 61 gets into the ring channel 17, and from there it is pressed into the ring piston working sleeve 19 by way of the flow-through openings 23.

There, the cooling fluid pressed in in this manner brings about a defined (adjustable by way of the solenoid 13) application of pressure to the profile seal 27 and thus an application of pressure to the spring-loaded ring piston 29, which can therefore be moved in translationally precise manner.

Because of the arrangement according to the invention, defined displacement of the outer cylinder 9 of the valve slide is thereby brought about, and precise regulation of the conveyed coolant volume flow is implemented.

After the warm-up phase of the engine (with the valve slide closed), the pressure in the pressure channel can be precisely regulated by means of the solenoid 13, in this manner, and thus defined displacement of the valve slide along the outer edge of the impeller 5 can be implemented, thereby in turn making it possible to precisely influence the engine temperature in continuous operation, so that not only the pollutant emission but also the friction losses and fuel consumption can be clearly reduced in the entire working range of the engine.

Even in the case of disadvantageous thermal general conditions, such as in the vicinity of the turbocharger, for example, and very severely limited installation space for the coolant pump in the engine compartment, the solution according to the invention guarantees optimal cooling with minimized construction volume, as a result of the provision of a solenoid that is integrated into the coolant pump housing and, at the same time, cooled by coolant in the coolant pump housing.

Furthermore, the solution according to the invention allows reliable activation of the valve slide with a very low drive power.

Even in the event of failure of the regulation, continued functioning of the coolant pump (fail-safe) is guaranteed by the solution according to the invention, since the solenoid 13 is open in the current-free state, so that the pressure in the pressure channel 16 and in the ring channel 17 drops, and the return spring 6 moves the valve slide into the (backmost) working position "OPEN" in this case.

In the event of spring-loaded "return movement" of the ring piston 29 into the "fail-safe position," the coolant pumped by the working piston is passed from the pressure channel 16 to the backflow bore 51, by way of the open solenoid 13, and from there back into the pump interior 8 of the coolant pump according to the invention.

The two embodiments of the solution according to the invention presented in the exemplary embodiments are characterized, in each instance, by a very simple design, in terms of production and assembly technology, which is cost-advantageous, can be "standardized" for different pump sizes, optimally utilizes the construction space available in the engine compartment, and does not require air-free filling in the plant.

Furthermore, the two embodiments of the solution according to the invention, as presented in the exemplary embodiments, are characterized by great operational security and reliability, and accordingly guarantee a high volumetric degree of effectiveness, in accordance with the case of use, in each instance.

In this connection, the solutions presented here can also be included in the engine management in simple and cost-advantageous manner.

REFERENCE SYMBOL LIST

1 pump housing
2 pump bearing
3 pulley
4 pump shaft
5 impeller
6 return spring
7 back wall
8 pump interior
9 outer cylinder
10 seal accommodation
11 shaft sealing ring
12 working housing
13 solenoid
14 inlet opening
15 pressure chamber
16 pressure channel
17 ring channel
18 sleeve accommodation
19 ring piston working sleeve
20 sealing crosspiece
21 bottom
22 outer cylinder
23 flow-through opening
24 inner cylinder
25 position-securing sleeve
26 wall disk
27 profile seal
28 contact crosspiece
29 ring piston
30 edge crosspiece
31 bypass seal
32 slanted disk
33 suction groove
34 push-through bore
35 push-through opening
36 insertion bore
37 cylinder sleeve
38 cylinder sleeve bottom
39 outflow opening
40 valve basket
41 valve spring
42 valve disk
43 pass-through opening
44 working spring
45 working piston
46 flow-through bore
47 slide shoe
48 pass-through bore
49 outlet opening
50 outflow groove
51 backflow bore
52 sealing ring
53 ring groove
54 piston ring
55 contact region
56 engagement hook
57 clamping sleeve
58 sleeve pass-through bore
59 piston space
60 bore
61 axial piston pump
62 cyclone
63 pump dome
64 wall disk attachment dome
65 backflow dome
66 engagement projections
67 clamping ring
68 laser bore
69 metal holding sheet
70 pump dome seal
71 attachment element
72 piston seal
73 wall disk pass-through bore
74 backflow dome seal

The invention claimed is:

1. A regulatable coolant pump having:

a pump interior, a pump housing having an impeller side and a design, a pump shaft mounted in, on, or in and on the pump housing in a pump bearing, driven by a pulley having a free, flow-side end, and having an axis of rotation, an impeller disposed on the free, flow-side end of the pump shaft, so as to rotate with the pump shaft and having a pump housing side and an outflow region, a pressure-activated valve slide spring-loaded via a return spring, having a back wall, having an outer cylinder variably covering the outflow region of the impeller, and disposed in the pump interior a sealing accommodation in the pump housing, a shaft sealing ring disposed in the sealing accommodation and between the impeller and the pump bearing, a working housing disposed on the pump housing and having a pump shaft side, a solenoid having an inlet opening and disposed in the working housing, a sleeve accommodation disposed to lie opposite the sealing accommodation in the pump housing on the impeller side of the pump housing, a ring channel worked into the sleeve accommodation with rotation symmetry relative to the axis of rotation of the pump shaft, a pressure channel connected to the ring channel, a pressure chamber adjacent to the inlet opening of the solenoid disposed in the working housing on the pump shaft side of the working housing, and emptying into the pressure channel such that the pressure chamber is connected via the pressure channel with the ring channel, a ring piston working sleeve having a sealing crosspiece, a bottom, an outer cylinder, an inner cylinder projecting beyond the outer cylinder, and an impeller-side end and disposed in the sleeve accommodation, the pump shaft rotating freely within the ring piston working sleeve, the outer cylinder having sleeve flow-through openings to the ring channel, the sleeve flow-through openings having a diameter and being disposed close to the bottom of the ring piston working sleeve, a position-securing sleeve attached, with shape fit and/or force fit, on the inner cylinder of the ring piston working sleeve, a wall disk disposed rigidly on the position-securing sleeve and having an outer edge, a ring piston having an impeller-side face wall and a crosspiece contact, the back wall of the pressure-activated valve slide being disposed with shape fit and/or force fit on the impeller-side face wall of the ring piston, a profile seal having an impeller side, disposed spaced apart from the bottom of the ring piston working sleeve approximately by the diameter of the sleeve flow-through openings, displaceable in the ring piston working sleeve, and connected, on the impeller side, with the ring piston, a bypass seal disposed on the outer edge of the wall disk, a slanted disk rigidly disposed on the impeller on the pump housing side of the impeller and having a sinking region, a suction groove worked into the sinking region, a rising region, and a transition region from the sinking region into the rising region, the transition region as well as all of the rising region being planar, a push-through bore in the wall disk, centered relative to the suction groove of the slanted disk, and having a bore axis, an insertion bore opening into the pressure channel, disposed in the pump housing, and aligned with the bore axis of the push-through bore, at least one first pass-through opening, the at least one first pass-through opening being disposed in the back wall of the pressure-activated valve slide and corresponding to the design of the pump housing, a cylinder sleeve disposed in the insertion bore with shape fit and/or force fit and having a cylinder sleeve bottom and an outside, an axial piston pump integrated into the cylinder sleeve, at least one outflow opening disposed in a region of the cylinder sleeve bottom of the cylinder sleeve, a valve basket with a valve disk and a valve spring pressing the valve disk against the cylinder sleeve bottom in a region of the at least one outflow opening, the valve basket being disposed in the region of the cylinder sleeve bottom and on the outside of the cylinder sleeve, at least one second pass-through opening, the at least one second pass-through opening being situated in the valve basket, a working spring disposed in the cylinder sleeve as an additional module of the axial piston pump and having an impeller side, a working piston having a flow-through bore and making contact with the working spring on the impeller side of the working spring, a slide shoe having a pass-through bore and disposed between the working piston and the slanted disk, the pass-through bore being worked into a related region of the suction groove and being adjacent to the flow-through bore of the working piston, an outflow groove disposed in the working housing, at least one backflow bore in the working housing and leading into the pump housing, an outlet opening:

disposed on the solenoid, disposed in the working housing directly adjacent to the at least one backflow bore or disposed indirectly, by way of the outflow groove, adjacent to the at least one backflow bore, wherein the at least one backflow bore connects the outlet opening with the pump interior, and wherein the return spring of the pressure-activated valve slide is disposed:

between the wall disk and the ring piston, or between the wall disk and the back wall of the pressure-activated valve slide.

2. The regulatable coolant pump according to claim 1, wherein the outlet opening opens into the at least one backflow bore.

3. The regulatable coolant pump according to claim 1, wherein the suction groove has first and second sides, wherein the slide shoe is dimensioned such that the slide shoe lies against the slanted disk on both the first and second sides of the suction groove, wherein the suction groove is worked into the slanted disk to a depth of 0.03 mm to 0.1 mm, and wherein the suction groove serves as a filter disk, in combination with the slide shoe.

4. The regulatable coolant pump according to claim 1, wherein the suction groove is worked into the slanted disk to a depth of 0.03 mm to 5.00 mm, and wherein the requlatable coolant pump further comprises a cyclone covering the suction groove and disposed between the slanted disk and the slide shoe.

5. The regulatable coolant pump according to claim 1, further comprising:

multiple domes projecting beyond the pump housing in a direction of the impeller and disposed on the pump housing, a pump dome disposed on the pump housing, at least one wall disk attachment dome disposed on the pump housing, as well as a backflow dome disposed on the pump housing, and wherein the at least one push-through opening is disposed in the back wall of the pressure-activated valve slide, in a region of the multiple domes, the pump dome, the at least one wall disk attachment dome, and the backflow dome for free displaceability of the pressure-activated valve slide.

6. The regulatable coolant pump according to claim 4, wherein the cyclone is connected, with shape fit via engagement projections, and with force fit via a clamping ring, with the slanted disk on the impeller.

7. The regulatable coolant pump according to claim 4, wherein the cyclone is formed by a thin-walled circular ring disk disposed in a region of the suction groove, and wherein the regulatable coolant pump further comprises:

a plurality of laser bores in the thin-walled circular ring disk, having a bore diameter of 0.03 mm to 0.2 mm, and disposed in the region of the suction groove.

8. The regulatable coolant pump according to claim 7, wherein the thin-walled circular ring disk has a thickness of 0.05 mm to 1.0 mm.

9. The regulatable coolant pump according to claim 7, wherein the laser bores of the plurality of laser bores have a respective conical cross-section having a respective smallest diameter, wherein a first side of the cyclone faces the slide shoe, and wherein the respective smallest diameters of the laser bores are disposed on the first side of the cyclone.

* * * * *